US005414213A

United States Patent [19]

Hillburn

[11] Patent Number: 5,414,213

[45] **Date of Patent: * May 9, 1995**

[54] SHIELDED ELECTRIC CABLE

[76] Inventor: Ralph D. Hillburn, 8 Whispering Pines Dr., Wallingford, Conn. 06492

[ * ] Notice: The portion of the term of this patent subsequent to Jun. 14, 2011 has been disclaimed.

[21] Appl. No.: 132,113

[22] Filed: Oct. 5, 1993

Related U.S. Application Data

[63] Continuation-in-part of Ser. No. 964,647, Oct. 21, 1992, Pat. No. 5,321,202.

[51] Int. Cl.[6] ..... H01B 11/18; H01B 13/22

[52] U.S. Cl. ..... 174/36; 29/828; 29/863; 156/54; 156/56; 174/105 R; 174/105 SC; 174/106 R; 174/106 SC; 439/578

[58] Field of Search ..... 174/36, 105 R, 105 SC, 174/106 R, 106 SC, 107; 156/53, 54, 56; 439/578; 29/828, 863

[56] References Cited

U.S. PATENT DOCUMENTS

| | | | |
|---|---|---|---|
| Re. 31,277 | 6/1983 | Gabriel et al. | 174/36 |
| 3,051,771 | 8/1962 | Lee | 174/36 |
| 3,193,712 | 7/1965 | Harris | 174/36 |
| 3,439,111 | 4/1969 | Miracle et al. | 174/107 |
| 3,459,877 | 8/1969 | Bullock et al. | 174/107 |
| 3,484,532 | 12/1969 | Anderson | 174/36 |
| 3,507,978 | 4/1970 | Jachlmowicz | 174/105 R |
| 3,624,267 | 11/1971 | Plummer | 174/36 |
| 3,662,090 | 5/1972 | Grey | 174/107 |
| 3,927,247 | 12/1975 | Timmons | 174/36 |
| 3,971,871 | 7/1976 | Haynes et al. | 428/392 |
| 4,092,452 | 5/1978 | Hori et al. | 174/107 |
| 4,117,260 | 9/1978 | Wilkenloh | 174/106 R |
| 4,125,739 | 11/1978 | Bow | 174/36 |
| 4,297,522 | 10/1981 | Jesse et al. | 174/36 |
| 4,323,721 | 4/1982 | Kincaid et al. | 174/36 |
| 4,327,246 | 4/1982 | Kincaid | 174/36 |
| 4,374,299 | 2/1983 | Kincaid | 174/36 |
| 4,376,920 | 3/1983 | Smith | 333/12 |
| 4,406,914 | 9/1983 | Kincaid | 174/107 |
| 4,408,089 | 10/1983 | Nixon | 174/34 |
| 4,439,633 | 3/1984 | Grooten | 174/106 R |
| 4,487,996 | 12/1984 | Rabinowitz et al. | 174/105 E |
| 4,510,346 | 4/1985 | Bursh, Jr. et al. | 174/36 |
| 4,513,170 | 4/1985 | Apodaca | 174/36 |
| 4,641,110 | 2/1987 | Smith | 174/36 X |
| 4,698,028 | 10/1987 | Caro et al. | 439/578 X |
| 4,871,883 | 10/1989 | Guiol | 174/36 |
| 4,912,283 | 3/1990 | O'Connor | 174/36 |
| 5,006,670 | 4/1991 | Plant | 174/106 SC |
| 5,107,076 | 4/1992 | Bullock et al. | 174/107 |
| 5,132,491 | 7/1992 | Mulrooney et al. | 174/36 |
| 5,170,010 | 12/1992 | Aldissi | 174/36 |
| 5,210,377 | 5/1993 | Kennedy et al. | 174/107 |
| 5,216,202 | 6/1993 | Yoshida et al. | 174/36 |
| 5,216,204 | 6/1993 | Dudek et al. | 174/102 SC |

*Primary Examiner*—Morris H. Nimmo
*Attorney, Agent, or Firm*—Woodcock, Washburn, Kurtz, Mackiewicz and Norris

[57] ABSTRACT

A shielded electric cable having a core including an insulated conductor. A first shielding member formed of an elongated ribbon of insulating material and a pair of elongated metal foil strips arranged in a parallel relationship with the ribbon and bonded to the opposite sides of the ribbon is applied longitudinally to the core and wrapped circumferentially therearound forming two concentric substantially closed shielded layers. A layer of plastic material, preferably foamed, surrounds the first shielding member and a second shielding member surrounds the plastic layer, the second shielding member being formed of non-braided metallic material. The layer of plastic material is bonded to the shielding members. The shielded electric cable is provided with an outer jacket of non-conducting material and having an appropriate O.D. for receiving a standard connector.

32 Claims, 3 Drawing Sheets

SHIELDED ELECTRIC CABLE

This is a continuation-in-part of application Ser. No. 964,647, filed Oct. 21, 1992, now U.S. Pat. No. 5,321,202, issued Jun. 14, 1994.

BACKGROUND OF THE INVENTION

The present invention relates to shielded electric cables for the transmission of small signals through the cables and particularly an improved shielding for the cables and method of making the cables.

It is common practice to provide a shielded cable for transmitting small signals. A shielded cable usually includes a core of one or more insulated conductors enclosed within at least one conducting layer. The shielding resists signal leakage from the core and eliminates or reduces the interfering effects of extraneous electrical fields. One type of shielded electric cable commonly used consists of a center conductor having a foam dielectric extending therearound to form a core. A first shield is provided by a multiple layer tape wrapped therearound. The tape comprises an elongated ribbon of insulting material with elongated metallic strips bonded to each side to sandwich the insulating material therebetween. One commercial form of such tape comprises a layer of aluminum foil, a layer of polypropylene and another layer of aluminum foil with or without an adhesive backing. It is also common to provide a second metallic shield formed from copper or aluminum braid which is then provided with an outer cover or jacket of non-metallic material. Shielded electric cables of the foregoing type are provided with standard electric connectors having a standard diameter selected to accommodate the braided shielded cables. Braided shields because of the spaces between the wire braids have the disadvantage of providing less than 100% coverage of the core. Additionally the braided shields are difficult to cut and attach to the standard electric electrical connectors thus increasing installation time and costs.

It would be desirable to provide shielded electric cables with multiple shields and use standard connectors but eliminate the conventional braided shield.

SUMMARY OF THE INVENTION

In accordance with the present invention there is provided a shielded electric cable having a core including an insulated conductor. A first shielding member formed from an elongated ribbon of insulating material and a pair of elongated metal foil strips arranged in a parallel relationship with the ribbon and bonded to opposite sides of the ribbon is applied longitudinally to the core and wrapped circumferentially around the core in a generally parallel relationship forming two concentric substantially closed shielding layers. A layer of plastic material surrounds the first shielding member and a second shielding member surrounds the plastic layer, the plastic layer being bonded to both shielding members, and the second shielding member being formed of non-braided metallic material. The shielded electric cable is provided with an outer jacket of non-conductive material.

In one aspect of the invention the second shielding member is formed of at least one layer of an elongated metallic foil strip applied longitudinally to the core and wrapped circumferentially around the layer of plastic with one of the longitudinal edges of the metallic strip engaging the opposite longitudinal edge to form a longitudinal joint with metal-to-metal contact.

In accordance with another aspect of the invention the second shielding member is formed by a tape having an elongated ribbon of insulating material and a pair of elongated metal foil strips arranged in parallel relation with the ribbon and bonded to the opposite sides of the ribbon, the tape being applied longitudinally to the core and wrapped circumferentially around the layer of plastic with one of the longitudinal edges of the tape bent back on itself and the opposite longitudinal edge bent inwardly on itself to form opposing longitudinal grooves with the opposing edges being received respectively in the opposing grooves to form a longitudinal joint with metal-to-metal contact.

In accordance with a further aspect of the invention, the second shielding member comprises a seamless metal sheath.

In accordance with another aspect of the invention there is provided a method of making a shielded electric cable having a core comprising an insulated conductor. The method includes the steps of applying a first shielding member to the core, the first shielding member comprising an elongated ribbon of insulating material and a pair of elongated metal foil strips arranged in a parallel relationship with the ribbon and bonded to the opposite sides of the ribbon, the first shielding member being applied longitudinally to the core and wrapped circumferentially around the core in a generally parallel relationship forming two concentric substantially closed shielding layers. The method further includes the steps of applying a layer of plastic material surrounding the first shielding member, applying a second shielding member surrounding the layer of plastic, the second shielding member being formed of non-braided metallic material, and applying an outer jacket of non-conductive material to the second shielding member to complete the shielded electric cable.

DESCRIPTION OF THE PREFERRED EMBODIMENT

Figure 1:
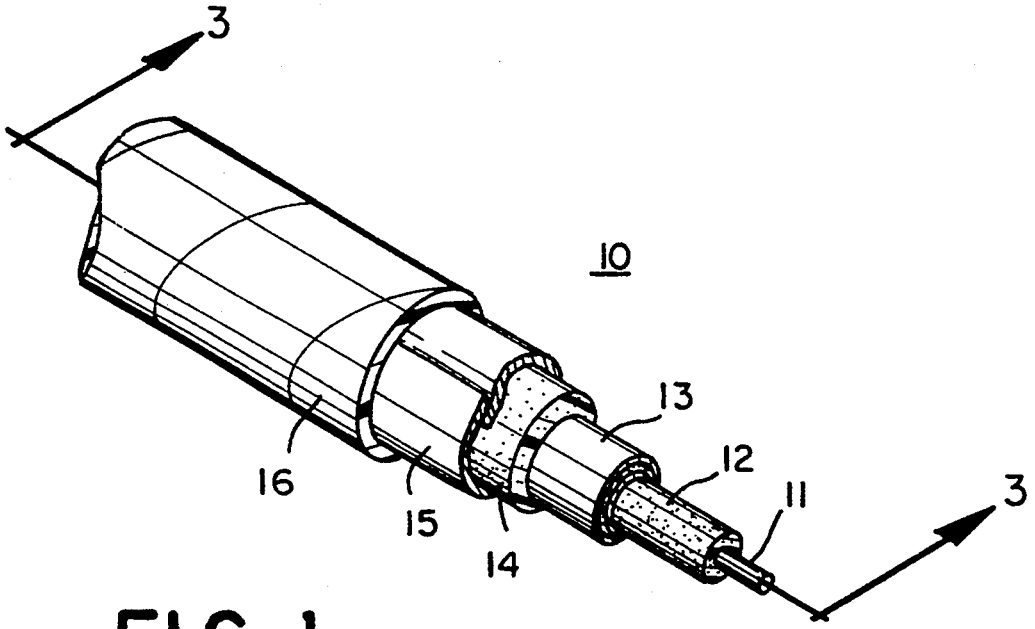
FIG. 1 is a perspective view of one embodiment of a shielded electric cable in accordance with the present invention having a portion thereof partially removed for illustration of the construction.

Referring to FIGS. 1, 1A, 3 and 5 there is illustrated a shielded electric cable 10 constructed in accordance with the present invention. The cable 10 includes a center conductor 11 having a foam dielectric insulating jacket 12. The conductor 11 with the insulating jacket 12 are commonly referred to as the core of the cable. A first shielding member 13 surrounds the core and comprises an elongated ribbon of insulating material 13*a* and a pair of elongated metallic foil strips 13*b* and 13*c* arranged in a parallel relationship with the ribbon 13*a* and bonded to the opposite sides of the ribbon. This shielding member 13 is in the form of a tape with an adhesive backing and is available commercially as APA tape from Facile Technologies, Patterson, N.J. Another suitable tape is AMA (aluminum-Mylar-aluminum) tape. The tape or shielding member 13 is applied longitudinally to the core and wrapped circumferentially around the core in a generally parallel relationship forming two concentric substantially closed shielding layers, each of the layers being formed by the respective one of the foil strips 13*b*, 13*c* with the longitudinal edge of the foil strip 13*b* forming the inner shielding layer overlapping with the opposite longitudinal edge of the foil strip 13*c* forming the outer shielding layer to provide direct contact with each other separated only by the adhesive backing. Alternatively, the tape 13 may be wrapped so that the longitudinal edges of the foil strips 13*b* and 13*c* meet to form butt joints. These types of joints are conventional and are illustrated generically in the drawings. A typical overlapping joint is shown on shielding member 15. The construction of the shielded electric cable 10 as thus far described is of standard construction.

Figure 1A:
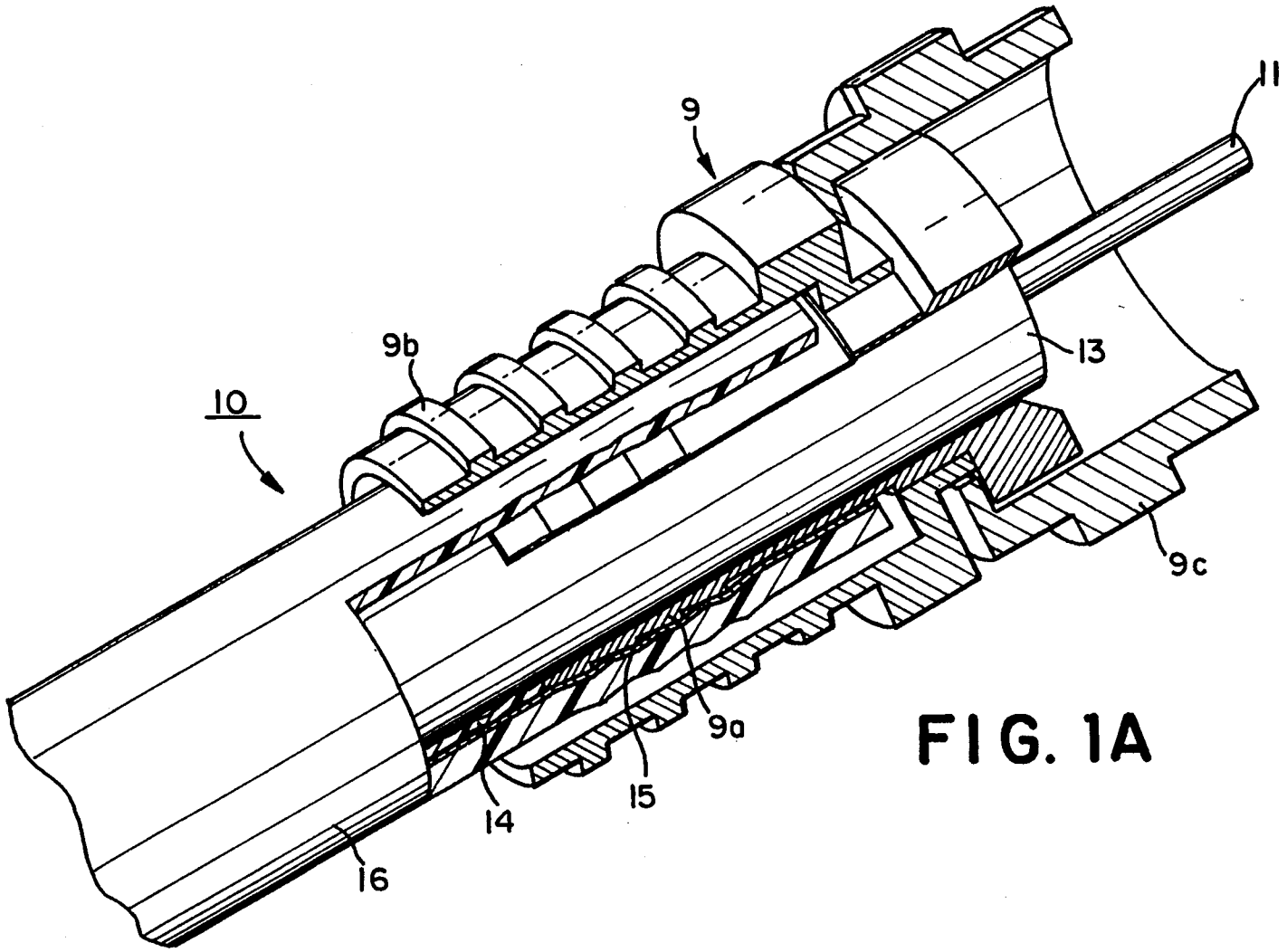
FIG. 1A is a perspective view on enlarged scale of the shielded electric cable of FIG. 1 assembled with a standard connector.
Figure 3:
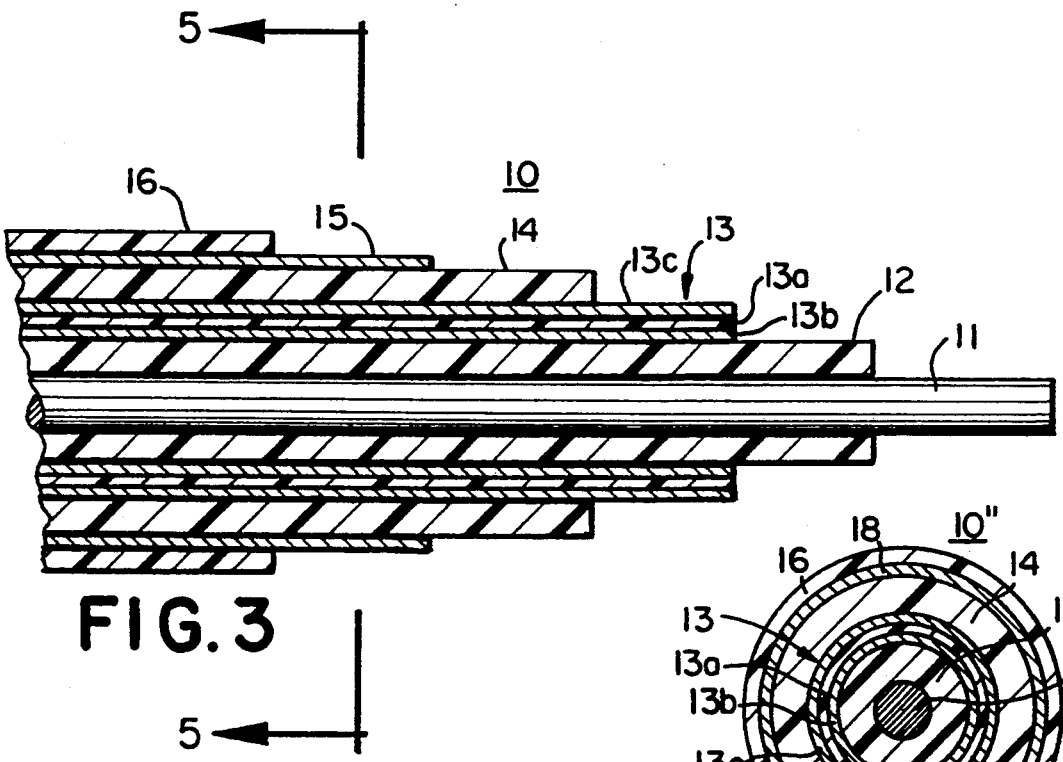
FIG. 3 is a longitudinal sectional view of the shielded electric cable shown in FIG. 1 taken along the lines 3—3 in FIG. 1.
Figure 5:
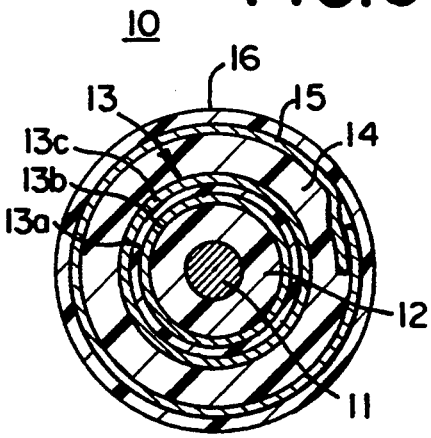
FIG. 5 is a transverse cross-sectional view of the shielded electric cable shown in FIGS. 1 and 3 and taken along the lines 5—5 in FIG. 3.

Normally a braided metallic shield would surround the shielding member 13. However, in the present invention the metallic braided shield has been eliminated and the shielding member 13 is provided with a layer of plastic material 14 of predetermined thickness. The plastic layer 14, preferably foamed, may be applied to the outer surface of the shield 13 either by extrusion or as a tape. The plastic layer 14 may be conductive, semi-conductive or non-conductive of either solid or foamed material. In one form of the invention the layer 14 was formed of foamed polyvinyl chloride. The plastic layer 14 may be extruded from other materials such as polyethylene and thermoplastic rubber (TPR). A second shielding member 15 surrounds the plastic layer 14. As shown in FIGS. 1, 3 and 5 the second shielding member 15 comprises an elongated metallic foil strip. The second shielding member 15 is applied longitudinally to the core and wrapped circumferentially around the layer 14 with one of the longitudinal edges of the metallic foil strip engaging the opposite longitudinal edge to form a longitudinal joint with metal-to-metal contact. The engagement may be edge-to-edge or overlapping. To improve the metal-to-metal contact on the edges of strip 25 a shorting fold can be used on the underneath edge of strip 15, FIGS. 1 and 5. The plastic layer 14 preferably is bonded to both the shielding members 13 and 15 to prevent the migration of moisture between the surfaces. This may be done by coating the mating surfaces with adhesive or by including an adhesive additive in the plastic material forming the layer 14. In one example, when an adhesive additive was included in the plastic material forming the layer 14, it was approximately 0.3% by weight and the remainder was thermoplastic rubber. The adhesive was ethylene acrylic acid copolymer manufactured by Dow Chemical under the trademark "PRIMACOR". The adhesive was heat activated upon the extrusion of an outer jacket to the second shielding member 15. The bond between the outer surface of the shielding member 13 and the inner surface of the plastic layer 14 and the bond between the outer surface of the plastic layer 14 and the inner surface of the shielding member 15 should be relatively light so that when the connector is assembled with the end of the cable 10, the layer 14 will be pushed back beneath the shielding member 15 so that the connector will make metal-to-metal contact with the inner shielding member 13 and the outer shielding member 15. This is best seen in FIG. 1A where the shielded electric cable 10 of FIG. 1 is assembled with a standard connector 9. The connector 9 includes a connector post 9*a*, a crimp ring 9*b* and a connector nut 9*c*. Connectors of this type are wellknown in the trade as a standard "F" fitting and are available commercially from Gilbert Engineering Co., Glendale, Ariz. As may be seen in FIG. 1A the plastic layer 14 has been pushed back beneath the shielding member 15 so that the connector post 9*a* makes metal-to-metal contact with the inner shielding member 13 and the outer shielding member 15. The cable 10 is provided with an outer jacket 16 of non-conductive material. The jacket 16 may be extruded or a helically wound tape preferably bonded to the shielding member 15. The jacket 16 may be made of polyethylene, polyvinyl chloride or other suitable non-conductive material.

Figure 2:
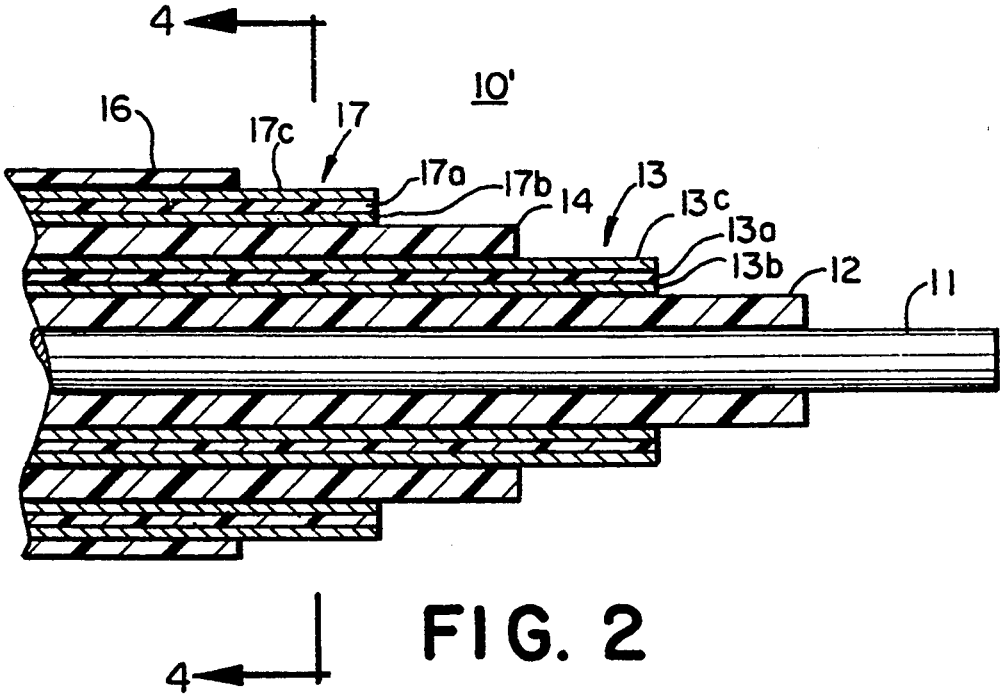
FIG. 2 is a longitudinal sectional view of another embodiment of a shielded electric cable in accordance with the present invention.
Figure 4:
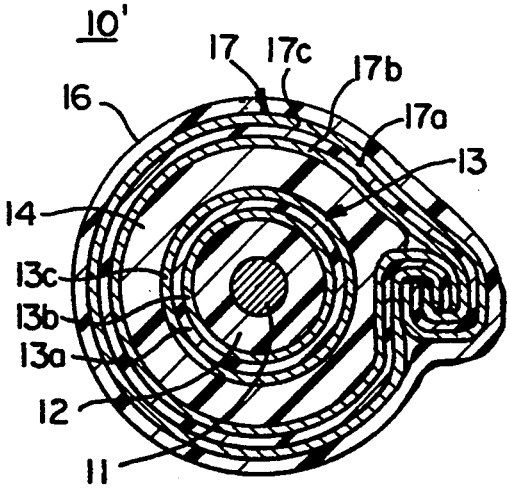
FIG. 4 is a transverse cross-sectional view of the embodiment of the shielded electric cable shown in FIG. 2 taken along the lines 4—4 in FIG. 2.

Referring to FIGS. 2 and 4 there is illustrated another embodiment of the shielded electric cable 10' constructed in accordance with the present invention. The cable 10' is similar to cable 10 except for the difference in the second shielding member as hereinafter described. As will be seen in FIGS. 2 and 4 the cable 10' includes a center conductor 11 having a foam dielectric insulating jacket 12. A first shielding member 13 surrounds the core and comprises an elongated ribbon of insulating material 13*a* and a pair of elongated metal foil strips 13*b* and 13*c* arranged in parallel relationship with the ribbon 13*a* and bonded to the opposite sides of the ribbon. The tape or shielding member 13 is applied longitudinally to the core and wrapped circumferentially around the core in a generally parallel relationship forming two concentric substantially closed shielding layers, each of the layers being formed by the respective one of the foil strips 13*b*, 13*c* with the longitudinal edge of the foil strip 13*b* forming an inner shielding layer overlapping with the opposite longitudinal edge of the foil strip 13*c* forming the outer shielding layer to provide direct contact with each other. As pointed out above the construction of the shielded electric cable 10' as thus far described is of standard construction.

Normally a braided metallic shield would surround the shielding member 13. However, in the present invention the metallic braided shield has been eliminated and the shielding member 13 is provided with a layer of plastic material 14 of predetermined thickness. The plastic layer 14, preferably foamed, may be applied to the outer surface of the shield 13 either by extrusion or as a tape. The tape may be pulled in longitudinally of the cable or wrapped therearound. As pointed out above the layer 14 may be conductive, semi-conductive or non-conductive and in one form of the invention the layer 14 was a foamed polyvinyl chloride. In the embodiment illustrated in FIGS. 2 and 4 a second shielding member 17 surrounds the foam layer 14. The second shielding member 17 is similar to the first shielding member 13 and comprises an elongated ribbon of insulating material 17*a* and a pair of elongated metallic foil strips 17*b* and 17*c* arranged in a parallel relationship with the ribbon 17*a* and bonded to opposite sides of the ribbon. The tape or shielding member 17*a* is applied longitudinally to the foam layer 14 and wrapped circumferentially around the layer of foam with one of the longitudinal edges of the tape bent back on itself and the opposite longitudinal edge bent inward on itself to form opposing longitudinal grooves with the opposing edges being received respectively in the opposing grooves to form a longitudinal joint with metal-to-metal contact. The plastic layer 14 preferably is bonded to both the first shielding member 13 and the second shielding member 17 as described above in connection with the embodiment of FIGS. 1, 1A, 3 and 5. An outer jacket 16 of insulating material is applied to the shielded electric cable 10' and preferably bonded to the second shielding member 17. While the circumference of the cable 10' in FIG. 4 is illustrated of irregular shape, it will be understood that in actual practice the circumference will be substantially circular. The reason for the irregular shape illustrated in FIG. 4 is the fact that it is necessary making the drawing to provide a certain width to the layers making up the second shielding member 17 and thus the joint for these members appears in the drawing as a thickened portion on the cable. In actual practice the thickness of the layers making up the second shielding layer 17 are relatively thin and thus even with the tin can fold joint illustrated in FIG. 4, or a Z-fold or any other shorting fold, the cable would nevertheless be substantially circular in circumference. Also the circumference and diameter would have a dimension such as to receive a standard electrical connector as shown in FIG. 1A.

In one embodiment of the invention constructed in accordance with FIGS. 2 and 4 the conductor 11 was copper and the insulation 12 was a foam dielectric. The first shielding member 13 comprised an elongated ribbon of polypropylene and a pair of elongated aluminum foil strips arranged in a parallel relationship with the polypropylene ribbon and bonded to the opposite sides thereof. This is known in the trade as an APA tape. The layer 14 was a foam polyvinyl chloride. The second shielding member 17 was similar to the tape forming the first shielding member 13. The outer jacket 16 was an extruded polyvinyl chloride jacket. In making an RG 6/u type cable, such as used in cable TV, the foam dielectric 12 had a O.D. of 0.180", the first shielding member 13 had an O.D. of 0.187", the thickness of the foam layer 14 was 0.005–0.010", the foam layer 14 had an O.D. of 0.202", the second shielding member 17 had an O.D. of 0.210" and the outer jacket 16 had a O.D. of 0.280".

The shielding members 13 and 17 may have metallic foils of materials other than aluminum. For example they may be copper or other metallic materials suitable for this application. Similarly, the center insulating ribbon of these shielding members may be of material other than polypropylene. The layer 14 may also be made of other materials than polyvinyl chloride and polyethylene which may also be foamed.

Figure 6:
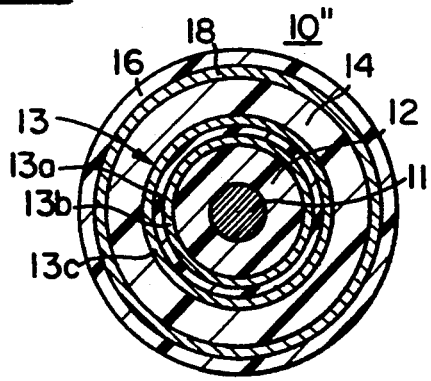
FIG. 6 is a transverse cross-sectional view of another embodiment of the invention.

Referring to FIG. 6 there is illustrated another embodiment of the invention. In this embodiment the shielded electric cable 10" is similar to the shielded electric cable 10 illustrated in FIGS. 1, 1A, 3 and 5 except the second shielding member comprises a seamless metal sheath 18. The corresponding parts have been identified in FIG. 6 with the same reference numerals. The sheath 18 may be formed from an aluminum seamless tubing, either drawn or butt-welded, which has been drawn down to fit the outside diameter of the plastic layer 14. After the seamless metal sheath 18 has been applied to the cable the sheath is covered by an outer non-conductive jacket 16 of polyvinyl chloride or other suitable electrical insulating material ready to receive the connector 9. It is to be understood that, if desired, the outer jacket 16 may be omitted in the various embodiments depending upon the application.

While there has been described a preferred embodiment of the invention, it will be understood that further modifications may be made without departing from the spirit and scope of the invention as set forth in the appended claims.

What is claimed is:

1. A shielded electric cable of predetermined diameter for assembly with a standard connector comprising a core comprising an insulated conductor, a first shielding member comprising an elongated ribbon of insulating material and a pair of elongated metallic foil strips arranged in a parallel relationship with the ribbon and bonded to opposite sides of the ribbon, the first shielding member being applied longitudinally to the core and wrapped circumferentially around the core in a generally parallel relationship forming two concentric, substantially closed shielding layers, a layer of plastic material of predetermined thickness surrounding said first shielding member, and a second shielding member surround said layer of plastic material, said second shielding member being formed of non-braided metallic material to facilitate assembly of the cable with a standard connector.

2. A shielded electric cable according to claim 1, wherein each of said shielding layers is formed by a respective one of the foil strips with the longitudinal edge of one of the foil strips forming the inner shielding layer overlapping the opposite longitudinal edge of the foil strip forming the outer shielding layer to provide direct contact with each other.

3. A shielded electric cable according to claim 1, wherein each of said shielding layers is formed by a respective one of the foil strips with the longitudinal edges of the foil strip forming the inner shielding layer meeting to form a butt joint and the longitudinal edges of the foil strip forming the outer shielding layer meeting to form a butt joint.

4. A shielded electric cable according to claim 1 including an outer jacket of non-conductive material.

5. A shielded electric cable according to claim 1 wherein said layer of plastic material is bonded to said first and second shielding members.

6. A shielded electric cable according to claim 1 wherein said layer of plastic material is bonded to said first and second shielding members and said second shielding member is bonded to said outer jacket.

7. A shielded electric cable according to claim 1 wherein said second shielding member comprises at least one layer of an elongated metallic foil strip applied longitudinally to the core and wrapper circumferentially around the layer of plastic material with one of the longitudinal edges of the metallic strip engaging the opposite longitudinal edge to form a longitudinal joint.

8. A shielded electric cable according to claim 1 wherein said second shielding member comprises a tape comprising an elongated ribbon of insulating material, and a pair of elongated metal foil strips arranged in parallel relationship with the ribbon and bonded to opposite sides of the ribbon, said tape being applied longitudinally to the core and wrapped circumferentially around the layer of plastic material with one of the longitudinal edges of the tape bent back on itself and the opposite longitudinal edge bent inwardly on itself to form opposing longitudinal grooves with the opposing edges being received respectively in the opposing grooves to form a longitudinal joint.

9. A shielded electric cable according to claim 1 wherein said second shielding member comprises a metal tube.

10. A shielded electric cable according to claim 1 wherein said layer of plastic is foam material.

11. A shielded electric cable according to claim 1 wherein said layer of plastic is conductive.

12. A shielded electric cable according to claim 1 wherein said layer of plastic is semi-conductive.

13. A shielded electric cable according to claim 1 wherein said layer of plastic is non-conductive.

14. A shielded electric cable according to claim 1 wherein said layer of plastic comprises polyvinyl chloride.

15. A shielded electric cable according to claim 1 wherein said layer of plastic comprises polyethylene.

16. A shielded electric cable according to claim 1 wherein said layer of plastic comprises thermoplastic rubber.

17. A shielded electric cable according to claim 1 wherein said layer of plastic includes a heat activated adhesive.

18. A method of making a shielded electric cable of predetermined diameter for assembly with a standard connector said cable having a core comprising an insulated conductor including the steps of applying a first shielding member to the core, the first shielding member comprising an elongated ribbon of insulating material and a pair of elongated metal foil strips arranged in a parallel relationship with the ribbon and bonded to the opposite sides of the ribbon, the first shielding member being applied longitudinally to the core and wrapped circumferentially around the core in a generally parallel relationship forming two concentric substantially closed shielding layers, applying a layer of plastic material of predetermined thickness surrounding the first shielding member, applying a second shielding member surrounding the layer of plastic, the second shielding member being formed of non-braided metallic material to facilitate assembly of the cable with a standard connector, and applying an outer jacket of non-conductive material to the second shielded member to complete the shielded electric cable.

19. The method of claim 18 wherein the layer of plastic material is applied to the first shielding member by extrusion.

20. The method of claim 18 wherein the layer of plastic material is applied to the first shielding member by wrapping a tape of plastic material around the first shielding member.

21. The method of claim 18 wherein the outer jacket of insulating material is applied by extruding the outer jacket on the second shielding member.

22. The method of claim 18 wherein said second shielding member is formed from metal tubing which has been drawn down to fit the outside diameter of the layer of plastic material.

23. The method of claim 18 wherein the layer of plastic material is in the form of a tape of foam material pulled longitudinally of the cable and applied to the first shielding member by wrapping the tape therearound.

24. The method of claim 18 wherein said layer of plastic material is a foam material.

25. The method of claim 18 wherein said layer of plastic material is non-conductive.

26. The method of claim 18 wherein said layer of plastic is semi-conductive.

27. The method of claim 18 wherein said layer of plastic is conductive.

28. The method of claim 18 wherein said layer of plastic material is bonded to said first and second shielding members.

29. The method of claim 28 wherein said layer of plastic includes a heat activated adhesive.

30. The method of claim 29 wherein said outer jacket is bonded to said second shielding member.

31. A method of assembling a shielded electric cable with a connector wherein the connector comprises a central connector post surrounded by a crimp ting and a connector nut and the shielded electric cable comprises a core having an insulated conductor, a first shielding member extending longitudinally of the core and wrapped circumferentially around the core, a layer of plastic material surrounding the first shielding member and a second shielding member surrounding the layer of plastic material, the second shielding member being formed of non-braided metallic material, said method comprising the steps of:

aligning the longitudinal axis of the connector with the longitudinal axis of the shielded electric cable, placing the end of the connector post in abutting relation with the adjacent end of the plastic layer of material in the shielded electric cable, applying a longitudinal force to the cable and connector to cause the plastic layer to be pushed back beneath the second shielding member so that the connector post will make metal-to-metal contact between the first shielding member and the second shielding member after the installation of the electrical connector.

32. The method according to claim 31 wherein the outer surface of the first shielding member is bonded to the inner surface of the plastic layer and the outer surface of the plastic layer is bonded to the inner surface of the second shielding member whereby these bonds are broken when the plastic layer is pushed back beneath the second shielding member by the connector post during assembly with the shielded electric cable.

* * * * *

UNITED STATES PATENT AND TRADEMARK OFFICE

CERTIFICATE OF CORRECTION

PATENT NO. : 5,414,213

DATED : May 9, 1995

INVENTOR(S) : Ralph D.Hillburn

It is certified that error appears in the above-indentified patent and that said Letters Patent is hereby corrected as shown below:

Column 8, claim 31, line 29, "ting" should be --ring--.

Signed and Sealed this

Fourth Day of July, 1995

Bruce Lehman

*Attest:*

BRUCE LEHMAN

*Attesting Officer*

*Commissioner of Patents and Trademarks*